US005227251A

United States Patent [19]

Suichi et al.

[11] Patent Number: 5,227,251

[45] Date of Patent: Jul. 13, 1993

[54] THIN CONTINUOUS CAST PLATE AND PROCESS FOR MANUFACTURING THE SAME

[75] Inventors: Isao Suichi; Shigenori Tanaka, both of Hikari, Japan

[73] Assignee: Nippon Steel Corporation, Tokyo, Japan

[21] Appl. No.: 761,827

[22] PCT Filed: Jan. 11, 1991

[86] PCT No.: PCT/JP91/00019

§ 371 Date: Sep. 11, 1991

§ 102(e) Date: Sep. 11, 1991

[87] PCT Pub. No.: WO91/10521

PCT Pub. Date: Jul. 25, 1991

[30] Foreign Application Priority Data

Jan. 12, 1990 [JP] Japan ..... 2-3518

[51] Int. Cl.[5] ..... B23P 9/00

[52] U.S. Cl. ..... 428/687; 164/480; 164/428

[58] Field of Search ..... 164/428, 480; 428/687, 428/685

[56] References Cited

FOREIGN PATENT DOCUMENTS

| | | | |
|---|---|---|---|
| 60-184449 | 9/1985 | Japan . | |
| 62-6738 | 1/1987 | Japan . | |
| 62-130749 | 6/1987 | Japan . | |
| 62-176650 | 8/1987 | Japan . | |
| 62-254953 | 11/1987 | Japan . | |
| 63-84701 | 4/1988 | Japan . | |
| 64-83340 | 3/1989 | Japan . | |
| 64-83343 | 3/1989 | Japan . | |
| 1-218743 | 8/1989 | Japan | 164/428 |
| 2-52152 | 2/1990 | Japan . | |
| 2-92438 | 4/1990 | Japan . | |
| 3-66459 | 3/1991 | Japan | 164/480 |

*Primary Examiner*—Kuang Y. Lin
*Attorney, Agent, or Firm*—Kenyon & Kenyon

[57] ABSTRACT

A tortoise shell pattern having a circle equivalent diameter of 5 to 200 μm surrounded by a dimple having a depth in the range of from 5 to 30 μm is formed on the surface of a thin continuous cast plate for the purpose of preventing the occurrence of surface cracking of the cast plate. The tortoise shell pattern is formed by conducting casting while regulating the overheating temperature, ΔT, of a molten metal in a pouring basin of a movable casting mold type continuous casting machine at 15° C. or below.

4 Claims, 6 Drawing Sheets

Casting direction

THIN CONTINUOUS CAST PLATE AND PROCESS FOR MANUFACTURING THE SAME

TECHNICAL FIELD

The present invention relates to a thin continuous cast plate manufactured through the use of a casting apparatus, such as a movable casting mold, for example, a twin drum system wherein use is made of a pair of cooling drums equipped with an internal cooling mechanism, a single drum system wherein use is made of a single cooling drum, or a drum-belt system wherein a pouring basin is formed between a cooling drum and a belt.

BACKGROUND ART

In recent years, in the field of continuous casting of a metal, various proposals have been made describing a technique for casting a thin cast plate having a thickness (2 to 10 mm) close to that of a final article by means of a continuous casting apparatus wherein use is made of a cooling drum provided with an internal cooling mechanism for the purpose of reducing the production cost and creating a new material.

In the above-described casting techniques, it is important to stably maintain the surface appearance of a cast plate on a high level. For this reason, proposals have been made on a casting technique wherein casting is conducted in the presence of an inert gas atmosphere for the purpose of preventing the formation of scum in a pouring basin (see Japanese Unexamined Patent Publication (Kokai) No. 62-130749), a roll brush technique wherein an oxide or the like deposited on the surface of a cooling drum is removed for the purpose of uniformly forming a solidified shell by means of a cooling drum (see Japanese Unexamined Patent Publication (Kokai) No. 62-176650), a technique as another means for achieving uniform formation of a solidified shell wherein a number of dimples are provided on the peripheral surface of a cooling drum so as to form an air gap serving as a heat insulating layer between the cooling drum and a solidifying shell (see Japanese Unexamined Patent Publication (Kokai) No. 60-184449), and other techniques.

Even in the above-described conventional casting techniques, it was difficult to stably prepare a cast plate having good surface appearance, and longitudinal and transversal cracks often occurred.

DISCLOSURE OF INVENTION

Under the above-described circumstances, an object of the present invention is to prevent the occurrence of cracking on the surface of a cast plate through the positive provision of a predetermined pattern on the surface of a cast plate as opposed to the prior art wherein the surface of the cast plate is made as even as possible. More specifically, an object of the present invention is to provide a cast plate having a tortoise shell pattern surrounded by a dimple on the surface of a thin continuous cast plate.

Another object of the present invention is to provide a process for producing said cast plate by means of a movable casting mold.

The present inventors have made various studies and, as a result, have found that the formation of a tortoise shell pattern having a circle equivalent diameter of 5 to 200 mm surrounded by a dimple having a depth of 5 to 30 μm on the surface of a cast plate is very effective for preventing the occurrence of surface cracking of the cast plate.

Further, the present inventors have proved that the above-described object can be attained by a casting process wherein the overheating temperature, ΔT, of a molten metal poured into a pouring basin of a casting mold of a movable mold type continuous casting machine is regulated to 15° C. or below as a means for forming the above-described pattern.

The term"circle equivalent" used herein is intended to mean a value obtained by converting the area A surrounded by a groove of a closed curve to the circle area $\pi d^2/4$ ($d=\sqrt{4A/\pi}$).

Further, the term "tortoise shell pattern" is intended to means an irregular pattern substantially surrounded by a dimple.

BEST MODE FOR CARRYING OUT THE INVENTION

The present invention will now be described in more detail in the case of a twin drum system.

Figure 4:
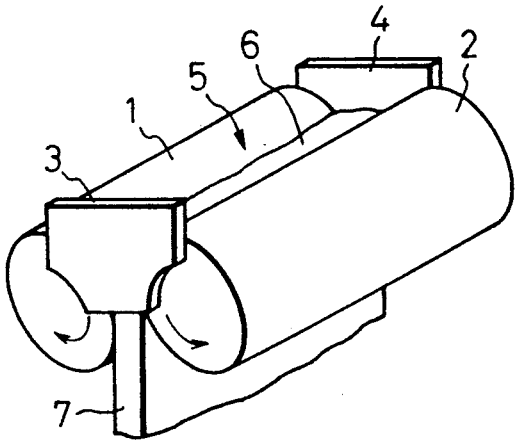
FIG. 4 is a schematic perspective view of a twin drum continuous casting machine.

FIG. 4 is a schematic diagram of a continuous casting machine of a twin drum system. In this drawing, a molten metal 6 fed into a pouring basin 5 defined by cooling drums 1 and 2 and side weirs 3 and 4 is rapidly cooled and solidified by means of the cooling drums 1 and 2 to form a solidified shell and extruded downward to form a cast plate 7.

Figure 3:
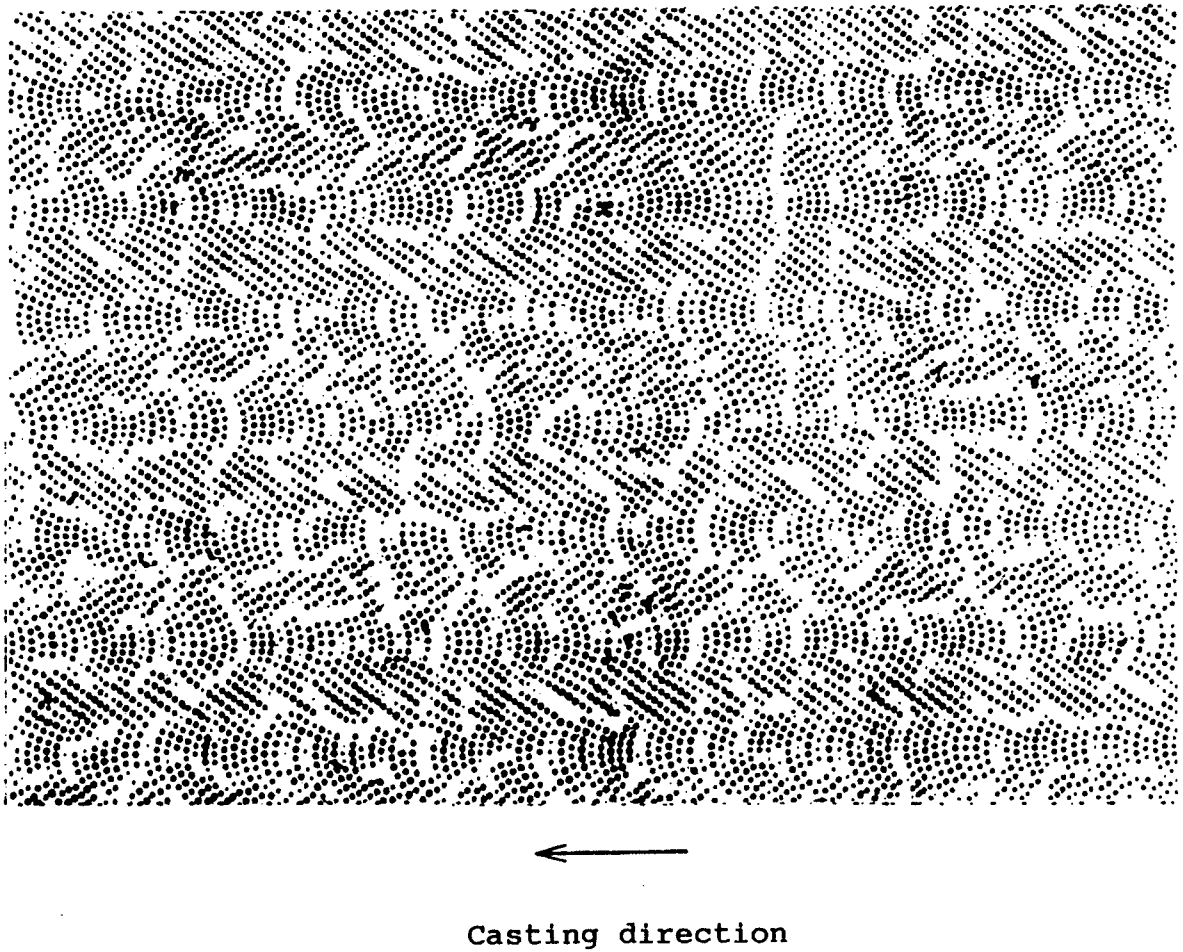
FIG. 3 is a rubbed copy of the surface state of the cast plate according to the present invention.

The surface of the cast plate 7 according to the present invention has a tortoise shell pattern as shown in FIG. 3. The tortoise shell pattern is identified, for example, by spraying a particulate carbon on the cast plate and making a rubbing of the tortoise shell pattern by means of a plastic pressure-sensitive tape to identify the pattern of a substantially closed curve (see FIG. 3). This pattern is defined by a dimple having a depth of about 5 μm or more, and in FIG. 3, the dimple is shown as a continuously linked white portion. The real surface area of the cast plate having a tortoise shell pattern is larger than that of a smooth cast plate. The conditions under which this pattern is formed in the step of cooling and solidification are such that the formation of a solidified shell is slow at the initial stage of solidification. This corresponds to the case where the overheating temperature of the molten metal is low. Under this condition, a solidified shell having a sufficient surface area is formed on the surface layer of a cast plate, and the shrinkage caused by the subsequent cooling and solidification of the inside of the cast plate causes tortoise shell dimple pattern to be formed on the surface of the solidified shell, so that no cracking occurs on the surface of the cast plate. This is because the critical strain is so large with respect to the fracture, by virtue of the thin shell of the surface layer, that the deformation according to the shrinkage stress is possible within the tolerable range. When the solidified shell thickness is too large due to excessive time for the formation of the solidified shell, it often becomes difficult to form the tortoise shell pattern by the subsequent shrinkage. In this case, there is a high possibility that the deformation is locally concentrated and consequently cracking occurs.

Figure 6A:
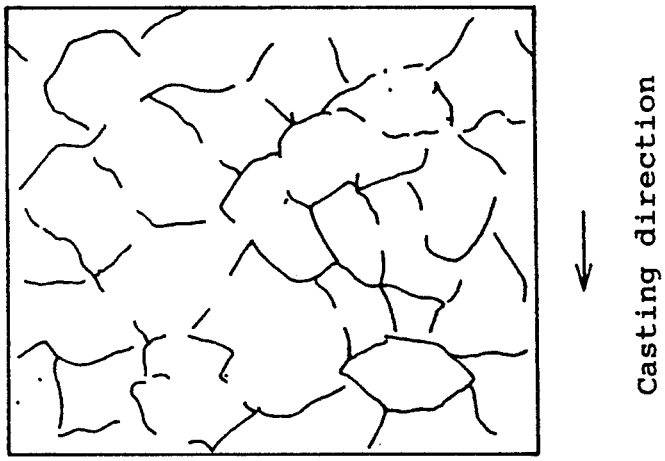
FIGS. 6A and 6B are respectively a plan view of a cross-sectional view showing the surface state of the cast strip of the present invention.
Figure 6B:
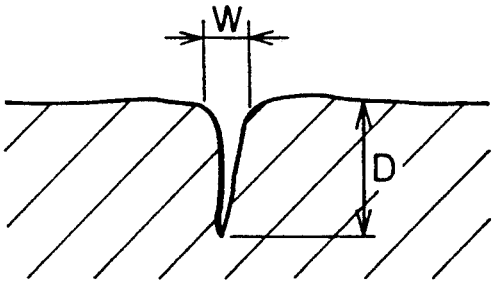

The pattern is in a tortoise shell form having a depth, D, of 5 to 30 μm and a circle equivalent diameter of 5 to 200 mm as shown in FIG. 6B. When the depth of the dimple exceeds 30 μm, this pattern is often left as uneven brightness at the time of cold rolling of the cast plate. When the circle equivalent diameter is less than 5 mm, since there is not significant difference in the real surface area between this cast plate and the smooth cast plate, the deformation falling within the critical strain range cannot absorb the shrinkage stress, so that cracking occurs. On the other hand, when the circle equivalent diameter exceeds 200 mm, the deformation caused by the solidification stress often concentrates on a very small portion of the dimple constituting the tortoise shell pattern, so that cracking occurs. By contrast, the cast plate having a tortoise shell pattern brings about neither longitudinal cracking nor transversal cracking and can stably maintain a good surface appearance of the cast plate.

Figure 1:
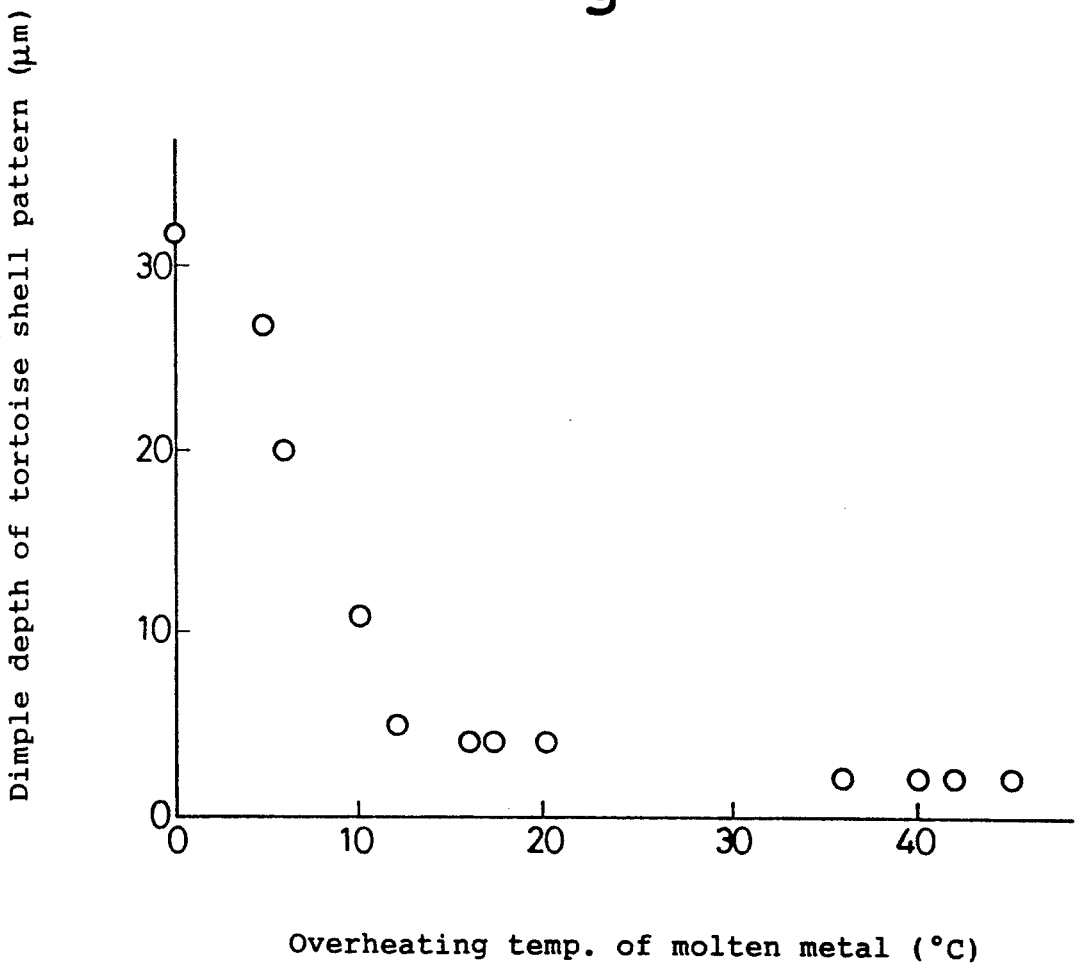
FIG. 1 is a diagram showing the relationship between the overheating temperature, ΔT (° C.), of a molten metal within a pouring basin and the dimple depth (μm) of the tortoise shell pattern.

FIG. 1 shows the relationship between the overheating temperature, ΔT (° C.), of the molten metal 6 within the pouring basin 5 and the dimple depth (μm) of the tortoise shell pattern in a continuous casting of an austenitic stainless steel thin cast plate through the use of a continuous casting apparatus of a twin drum system shown in FIG. 4. As is apparent from the drawing, there is a tendency that the higher the overheating temperature, the smaller the dimple depth.

Figure 2:
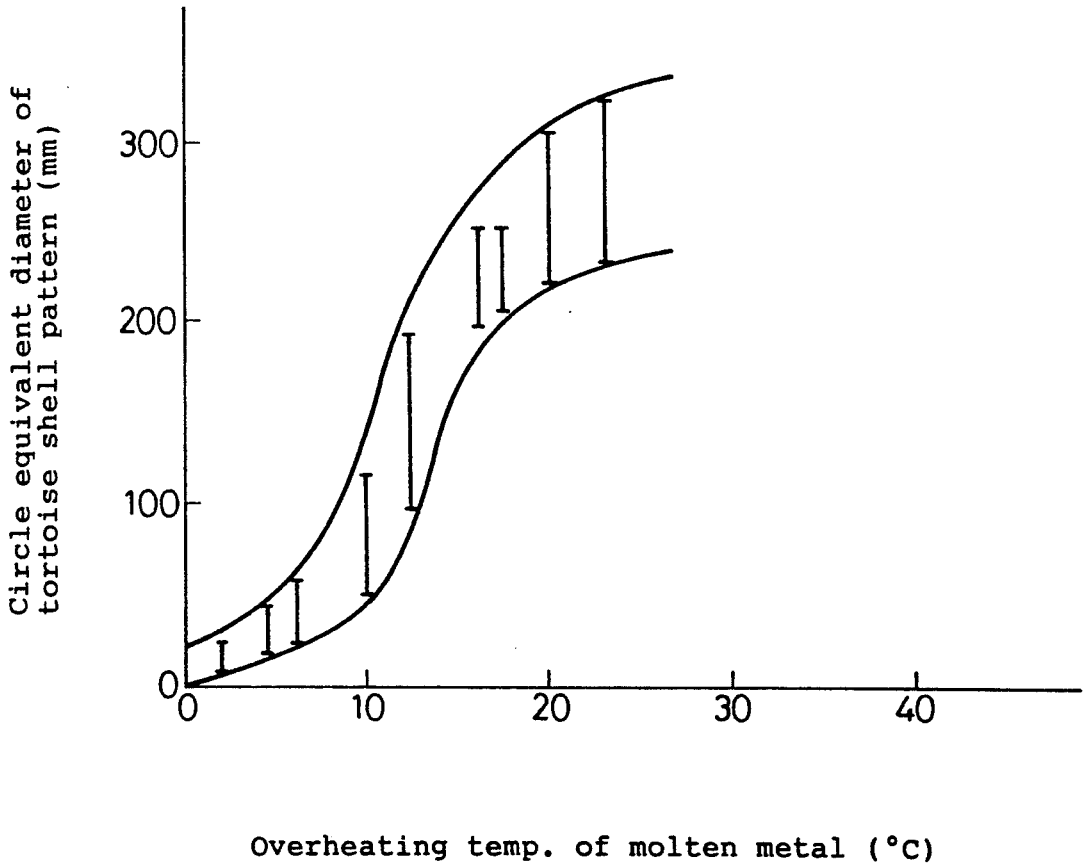
FIG. 2 is a diagram showing the relationship between the circle equivalent diameter (mm) of a tortoise shell pattern for each ripped surface depth (μm) of the tortoise shell pattern and the overheating temperature, ΔT (° C.), of a molten metal within a pouring basin.

FIG. 2 shows the relationship between the overheating temperature, ΔT (° C.), of the molten metal within the pouring basin and the circle equivalent diameter (mm) of the tortoise shell pattern of each dimple depth (μm) manufactured under the same condition as shown in FIG. 1. As is apparent from the drawing, there is a tendency that the higher the overheating temperature, the larger the circle equivalent diameter of the tortoise shell pattern and the smaller the dimple depth. In order to attain conditions which do not bring about the occurrence of surface cracking of the cast plate, i.e., a tortoise shell pattern having a circle equivalent diameter of 200 mm or less and a dimple depth of 5 μm or more, as can be seen from FIGS. 1 and 2, it is necessary that the overheating temperature, ΔT (° C.), of the molten metal within the pouring basin be 15° C. or below.

The present invention will now be described by way of the following Examples.

EXAMPLES

An austenitic stainless steel having an SUS304 composition manufactured by the conventional procedure was cast into a thin cast plate having a plate width of 800 mm and a plate thickness of 2 mm at a casting speed of 80 m/min through the use of a continuous casting machine of a twin drum system shown in FIG. 4. In this case, the temperature of the molten metal 6 at the pouring basin 5 was varied by varying the overheating temperature, ΔT, and use was made of cooling drums 1, 2 having depressions in a circular or elliptical form having a diameter of 0.1 to 1.2 mm and a depth of 5 to 100 μm ununiformly provided on the periphery thereof.

Figure 5:
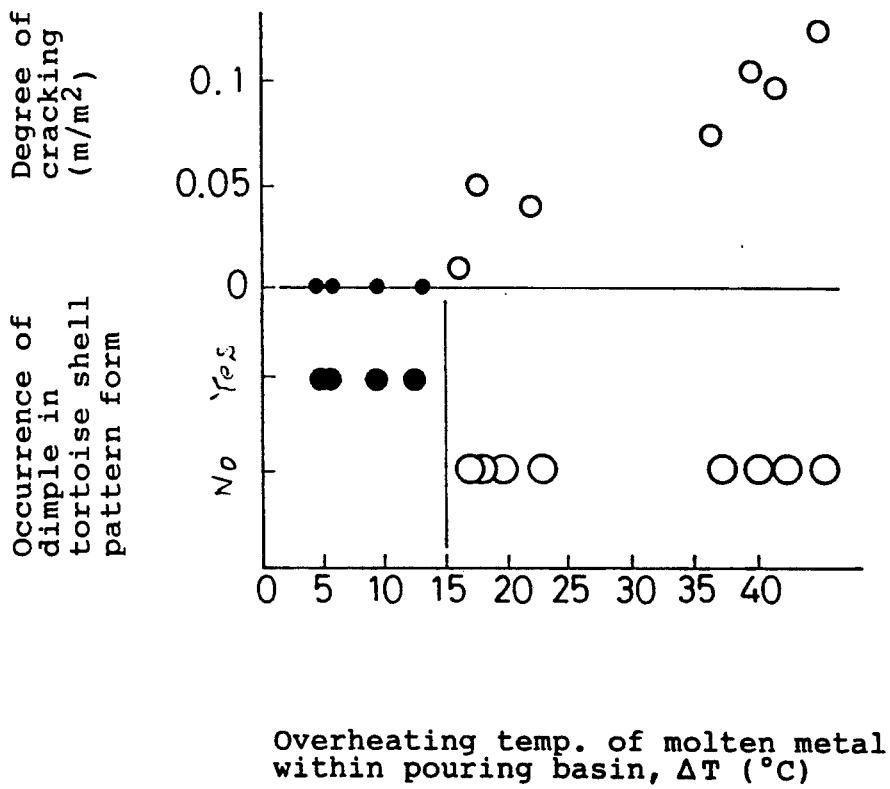
FIG. 5 is a diagram showing the relationship between the overheating temperature, ΔT (° C.), of molten metal within a pouring basin and the occurrence of a tortoise shell dimple pattern and the degree of occurrence of cracking ($m/m^2$)

The surface appearance and degree of cracking ($m/m^2$) of the resultant cast plate are shown in Table 1 and FIG. 5.

The dimple depth of the tortoise shell pattern was measured by the following method. Specifically, a portion including a closed curve was detected by a rubbed copy in the case of a dimple depth of 5 μm or more and by optical means in the case of a dimple depth of less than 5 μm. The roughness of the portion was measured by means of a roughness meter, and the maximum value was regarded as the above-described dimple depth.

The circle equivalent diameter of the tortoise shell pattern was regarded as the circle equivalent diameter of the detected portion.

As given in Nos. 1 to 4 of Table 1, it has been confirmed that when the overheating temperature, ΔT, of the molten metal 6 is 15° C. or below, the tortoise shell pattern as shown in FIG. 3 according to the present invention is formed and the degree of cracking is substantially zero. Thus, the casting through the use of a molten metal having an overheating temperature, ΔT, of 15° C. or below contributes to alleviation in the occurrence of cracking derived from the heat shrinkage of the cast plate and, at the same time, enables a tortoise shell dimple to be formed on the surface of the cast plate, and the relaxation of the cooling of the cast plate and the prevention of rapid lowering of the surface temperature of the cast plate by means of the cooling drums having depressions ensures the formation of the tortoise shell pattern and can suppress the variation in the dimension of the pattern. In this case, the width, W (see FIG. 6), of the dimple of the tortoise shell pattern shown in FIG. 3 was about 2 mm. It is matter of course that the cold-rolling of this cast plate brought about no surface defect.

There is a tendency that the lower the overheating temperature, ΔT, of the molten metal, the larger the dimple depth.

As is apparent from Nos. 6 to 12 as Comparative Examples of Table 1, when the casting was conducted under condition of an overheating temperature, ΔT, higher than 15° C., even in the case of use of the same cooling drums as those of the present invention, no tortoise shell pattern was formed and the degree of cracking increased. In particular, when the casting was conducted at a high temperature of a ΔT value of 40° C. or more, the degree of cracking was rapidly increased and reached 0.1 $m/m^2$.

The degree of cracking was quantified by pickling the cast plate having a length of 4 m after casting to measure the flaw present in the cast plate and converting the measured value to the unit area.

TABLE 1

| | No. | Overheating temp. (°C.) | Tortoise shell patern | Dimple depth (μm) | Circle equivalent diameter of tortoise shell pattern (mm) | Degree of cracking ($m/m^2$) | Uneven brightness of tortoise shell pattern |
|---|---|---|---|---|---|---|---|
| Example of | 1 | 5 | Yes | 27 | 6–10 | 0 | No |
| present | 2 | 6 | Yes | 20 | 7–15 | 0 | No |
| invention | 3 | 10 | Yes | 11 | 50–110 | 0 | No |
| SUS304 | 4 | 12 | Yes | 5 | 100–190 | 0 | No |
| Comparative | 5 | 0 | Yes | 32 | 6–10 | 0 | Yes |
| Example | 6 | 16 | No | 4 | 200–250 | 0.01 | No |
| SUS304 | 7 | 17 | No | 4 | 210–250 | 0.05 | No |
| | 8 | 23 | No | 4 | 230–320 | 0.04 | No |
| | 9 | 36 | No | 2 | 1–4 | 0.07 | No |
| | 10 | 40 | No | 2 | 1–4 | 0.10 | No |
| | 11 | 42 | No | 2 | 1–4 | 0.09 | No |
| | 12 | 45 | No | 2 | 1–4 | 0.13 | No |

INDUSTRIAL APPLICABILITY

As is apparent also from the foregoing Examples, in the present invention, the occurrence of the cracking and uneven brightness is suppressed by positively forming a desired pattern on the surface of a thin continuous cast plate, which enables reliable results unattainable by the prior art to be obtained, so that it becomes possible to provide a product having better surface quality and material quality.

We claim:

1. A thin continuous cast plate characterized in that a tortoise shell pattern having a circle equivalent diameter of 5 to 200 mm surrounded by dimples having a depth in the range of from 5 to 30 μm is formed on the surface of said cast plate.

2. A cast plate according to claim 1, wherein said thin cast plate is an austenitic stainless steel cast plate.

3. A process for continuously casting a thin cast plate, which comprises casting a thin cast plate by means of continuously moving shaping surface type continuous casting machine, characterized in that the casting is conducted while regulating the overheating temperature, ΔT, of a molten metal in a pouring basin formed by said movable casting mold at 15° C. or below.

4. A process according to claim 3, wherein said movable casting mold comprises cooling drums equipped with depressions and side weirs.

* * * * *

UNITED STATES PATENT AND TRADEMARK OFFICE

CERTIFICATE OF CORRECTION

PATENT NO. : 5,227,251

DATED : July 13, 1993

INVENTOR(S) : Isao SUICHI, et al.

It is certified that error appears in the above-identified patent and that said Letters Patent is hereby corrected as shown below:

Column 2, line 15, change "means" to --mean--.

Column 2, line 25, change "ripped" to --rippled--.

Column 2, line 33, between "of" and "molten" insert --a--.

Column 6, line 22, before "continuously" insert --a--.

Signed and Sealed this

Twenty-second Day of March, 1994

*Attest:*

Bruce Lehman

BRUCE LEHMAN

*Attesting Officer*

*Commissioner of Patents and Trademarks*